United States Patent [19]

von Blanquet

[11] 4,363,315

[45] Dec. 14, 1982

[54] OVEN WITH VISIBLE DISPLAYS

[75] Inventor: Georg von Blanquet, Baden-Baden, Fed. Rep. of Germany

[73] Assignee: Gaggenau-Werke Haus- und Lufttechnik GmbH, Gaggenau, Fed. Rep. of Germany

[21] Appl. No.: 198,282

[22] Filed: Oct. 17, 1980

[30] Foreign Application Priority Data

Oct. 31, 1979 [DE] Fed. Rep. of Germany ..... 2943917

[51] Int. Cl.[3] ..... A21B 1/00

[52] U.S. Cl. ..... 126/273 R; 126/19 R

[58] Field of Search ..... 126/19 R, 21 R, 273 R, 126/213, 97, 273 A, 275 R, 275 E; 427/166

[56] References Cited

U.S. PATENT DOCUMENTS 3,623,472 11/1971 Mazza ..... 126/273 R
4,106,861 8/1978 Brewer et al. ..... 427/166
4,206,252 6/1980 Gordon ..... 427/166
4,211,909 7/1980 Yoshida ..... 126/273 R

*Primary Examiner*—James C. Yeung
*Attorney, Agent, or Firm*—Wenderoth, Lind & Ponack

[57] ABSTRACT

An oven includes an oven structure having an oven interior, an oven door for closing the oven interior, the oven door having a transparent or translucent front plate for allowing viewing of the oven interior through the oven door, and visible adjustment and display elements for setting and displaying parameters relating to the operation of the oven. The adjustment and display elements are visual elements mounted to be covered by the front plate when the oven door is closed. The front plate has light absorbing coloration or a reflective, translucent coating to allow only the visual elements and the oven interior when illuminated to be viewed therethrough.

10 Claims, 1 Drawing Figure

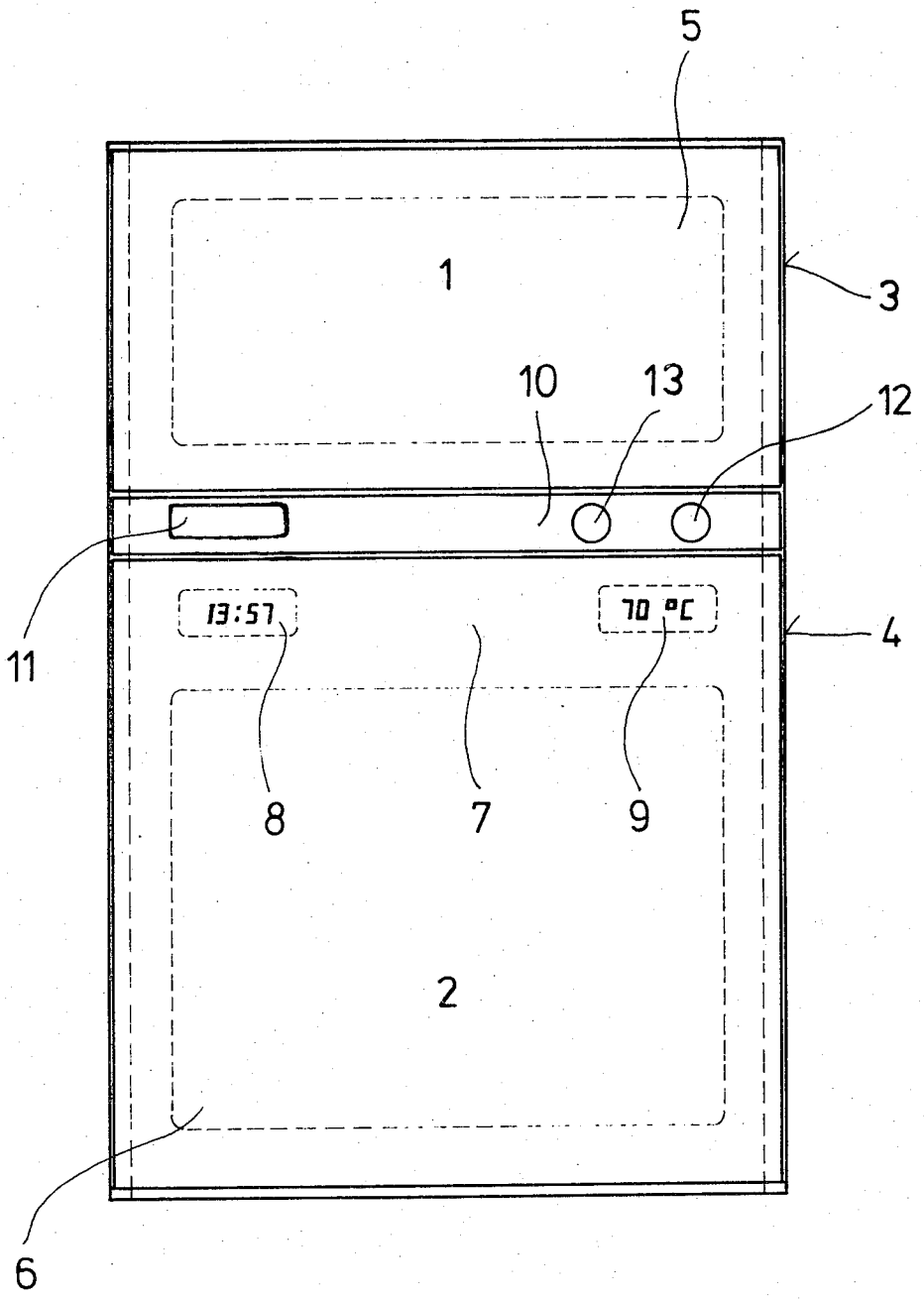
5
1
3
10
13
12
11
13:57
70 °C
4
8
7
9
2
6

OVEN WITH VISIBLE DISPLAYS

BACKGROUND OF THE INVENTION

The present invention relates to an improved oven of type including an oven structure having an oven interior, an oven door for closing the oven interior, the oven door having a transparent or translucent front plate for allowing viewing of the oven interior through the oven door, and visual adjustment and/or display elements for setting and displaying parameters relating to the operation of the oven.

There are already known ovens in combination with stoves wherein there is provided a vapor coating or tinted hard glass plate in association with the oven door to observe the broiling or baking taking plate within the oven interior when the interior is illuminated. Adjustment controls and display devices are located outside the oven on a service panel on which a digital clock is provided to set the baking or broiling time. In many models, the type of setting, for example top heat, is indicated by corresponding symbols, for example with letters or words by a light display.

Known types of stoves with ovens or separate multiple ovens have the disadvantage that the arrangement of the service panel with its visual adjustment and/or display elements prevents the overall front of the oven from having a unitary surface. Such a unitary surface or appearance is desirable and often necessary with the exacting demands of designs of modern kitchens. The constantly visible display elements present a particular distraction to a unitary surface design, as do the illuminated setting symbols which are visible when turned on.

SUMMARY OF THE INVENTION

With the above discussion in mind, it is the object of the present invention to provide an improved oven overcoming the above prior art disadvantages and providing an oven having a front surface which is unitary and esthetic, without the adjustment and/or display device constantly being visable and interrupting the unitary surface and appearance of the front of the oven.

This object is achieved in accordance with the present invention by the provision that the adjustment and display elements are visual elements mounted at locations to be covered by the front plate when the oven door is closed and that the front plate includes means for allowing only the visual elements and the oven interior when illuminated to be visible therethrough. By this arrangement, the adjustment and display elements are covered by the front plate of the oven door and are visible therethrough only when desired.

The front plate may be provided with light absorbing coloration. Alternatively, the front plate may have a reflective, translucent coating applied to the inner surface. By these provisions, the adjustment and display elements are visible through the front plate only when the display elements are switched on. This arrangement also provides protection to the adjustment and display elements from damage.

The coating applied to the inner surface of the front plate may comprise a vapor deposited layer of material, preferably gold.

The front plate preferably comprises a hard glass plate.

In accordance with a further feature of the present invention, the oven structure includes a strap-shaped support, and the visual elements are inserted or embedded within the strap-shaped support. The visual elements may be light emitting elements, such as light emitting diodes. Alternatively, the visual elements may be fluorescent. The strap-shaped support would thus partially replace the service panel on known ovens.

In accordance with a further features of the present invention, the oven may additionally include an intermediate plate separate from the front plate, with additional visual elements mounted behind the intermediate plate. The intermediate plate may have a light absorbing coloration or a reflective, translucent coating to allow the additional visual elements to be visible therethrough. In this arrangement of the present invention, some of the visual elements are thus covered by the front plate, while the remainder of the visual elements are covered by the intermediate plate.

The visual elements may additionally be any type of illuminable figures, for example symbols, letters or words for operational settings or displays relating to operational parameters of the oven.

BRIEF DESCRIPTION OF THE DRAWING

Other objects, features and advantages of the present invention will be apparent from the following detailed description, taken with the accompanying drawing, wherein the single FIGURE comprises a schematic elevation view of a double oven embodying the present invention.

DETAILED DESCRIPTION OF THE INVENTION

With reference now to the drawing, one embodiment of the present invention will be described. Specifically, in accordance with this embodiment of the present invention, there is shown a double oven including an upper warming oven 1 combined with a lower baking oven 2. Ovens 1 and 2 are provided with oven doors 3 and 4, respectively, for closing the respective oven interiors. The oven doors 3 and 4 are each provided with a transparent front plate 5, 6, respectively, made of hard glass plate.

The front plate 6 of the lower oven 2 covers a strap-shaped support 7 which is part of the oven structure and in which is embedded or inserted a timing clock 8 and a temperature display 9, for example displaying the readings of a remote thermometer or a boiling probe. Thus, when the door 4 is closed, the front plate 6 covers the visual elements 8 and 9.

Additional visual display elements in the form of setting markings, indicator letters or the like can be placed on a service panel 10 disposed above the front plate 6. The service panel 10 is then covered by an intermediate plate 11 which is separate from the front plate 6. Temperature setting controls 12 and 13 are arranged so as to be directly accessible on the service panel 10.

The front plates 5 and 6, as well as intermediate plate 11, are provided with means for allowing only the visual elements and the oven interior when illuminated to be visible therethrough. Thus, plates 5, 6 and 11 may have light absorbing coloration or tint such as to enable the visual elements to be seen therethrough only when illuminated. Also, the plates 5, 6 and 11 may be provided on the inner surfaces thereof with thin translucent coatings which are totally reflective from the front and which are such as to allow the visual elements to be visible only when turned on. The coatings may comprise a vapor deposited layer of a material, preferably gold.

Accordingly, the illuminated display symbols of the visual elements 8, 9 or the markings covered by the intermediate plate are visible through the plate only when illuminated. Further, the entire front surface of the oven is substantially unitary in appearance when all of the elements are turned off. This greatly enhances the esthetic design possibilities of the oven in relationship to an overall kitchen.

The visual elements may be light emitting elements, for example light emitting diodes. Alternatively, the visual elements may be fluorescent elements. The circuitry of the visual elements can be designed so that a continuous digital time read-out on the timer clock 8 remains visible even when the oven is turned off. It will be readily apparent that the various visual elements may be digital or otherwise.

The various specific elements of the timer and selector or details of the mode of heating with heating elements directly or indirectly do not in and of themselves form the present invention, and therefore they will not be described or illustrated. It is however contemplated that the present invention may be operable with any such elements as are known in the art.

Although the present invention has been described and illustrated with respect to a preferred embodiment, various modifications and alterations may be made to the specifically disclosed structure without departing from the scope of the present invention.

I claim:

1. In an oven of the type including an oven structure having an oven interior, an oven door for closing said oven interior, and visible adjustment and display elements for setting and displaying parameters relating to the operation of the oven, the improvements wherein:

said oven structure includes a support;

said adjustment and display elements are visual elements mounted on said support;

said oven door comprises a transparent or translucent front plate for allowing viewing therethrough;

said support and said visual elements are covered by said front plate when said oven door is closed; and said front plate has light absorbing or reflecting means for imparting to said front plate properties such that only said visual elements and said oven interior when illuminated are visible through said front plate, and such that said visual elements and oven interior when not illuminated are not visible through said front plate.

2. The improvement claimed in claim 1, wherein said means comprises light absorbing coloration in said front plate.

3. The improvement claimed in claim 1, wherein said means comprises a totally reflective, translucent coating applied to the inner surface of said front plate.

4. The improvement claimed in claim 3, wherein said coating comprises a vapor deposited layer of material.

5. The improvement claimed in claim 4, wherein said material comprises gold.

6. The improvement claimed in claim 1, wherein said front plate comprises a hard glass plate.

7. The improvement claimed in claim 1, wherein said support comprises a strap-shaped support, and said visual elements are inserted in said support.

8. The improvement claimed in claim 1, further comprising an intermediate plate separate from said front plate, and additional visual elements mounted behind said intermediate plate, said intermediate plate having a light absorbing coloration or a reflective, translucent coating to allow said additional visual elements to be visible therethrough only when illuminated.

9. The improvement claimed in claims 1 or 8, wherein said visual elements are light emitting.

10. The improvement claimed in claims 1 or 8, wherein said visual elements are fluorescent.

* * * * *